US008418896B1

(12) United States Patent
Higa

(10) Patent No.: US 8,418,896 B1
(45) Date of Patent: Apr. 16, 2013

(54) SOCK DONNING ASSISTANCE APPARATUS

(76) Inventor: Glenn Higa, Burbank, CA (US)

( * ) Notice: Subject to any disclaimer, the term of this patent is extended or adjusted under 35 U.S.C. 154(b) by 8 days.

(21) Appl. No.: 13/224,261

(22) Filed: Sep. 1, 2011

Related U.S. Application Data

(60) Provisional application No. 61/506,919, filed on Jul. 12, 2011.

(51) Int. Cl.
*A47G 25/90* (2006.01)

(52) U.S. Cl.
USPC ..... 223/112; 223/111

(58) Field of Classification Search ..... 223/112, 223/111, 113, 118, 119; D2/642
See application file for complete search history.

(56) References Cited

U.S. PATENT DOCUMENTS

| | | | | |
|---|---|---|---|---|
| 3,401,856 | A * | 9/1968 | Berlin | 223/111 |
| 3,452,907 | A * | 7/1969 | Maclauchlan | 223/111 |
| 4,260,083 | A * | 4/1981 | Aslin | 223/111 |
| 4,651,909 | A * | 3/1987 | Banting | 223/111 |
| 4,789,087 | A * | 12/1988 | Doorenbos | 223/111 |
| 4,991,757 | A * | 2/1991 | Deakyne | 223/112 |
| 5,799,844 | A * | 9/1998 | James | 223/112 |
| 5,909,831 | A * | 6/1999 | Griffin | 223/112 |
| 6,032,839 | A * | 3/2000 | Joosten et al. | 223/112 |
| 6,234,370 | B1 * | 5/2001 | Kummerle et al. | 223/112 |
| 7,234,616 | B2 * | 6/2007 | Thom et al. | 223/112 |
| 2007/0062986 | A1 * | 3/2007 | Doud | 223/111 |
| 2011/0297709 | A1 * | 12/2011 | Needham | 223/111 |

* cited by examiner

*Primary Examiner* — Nathan Durham
(74) *Attorney, Agent, or Firm* — Gulf Coast Intellectual Property Group

(57) ABSTRACT

A sock donning apparatus operable to assist an individual with restricted mobility to apply a sock to their foot. The sock donning apparatus further includes a body having a central panel that is generally tapered in shape. The central panel has integrally formed therewith a first side panel and a second side panel. The first side panel and second side panel are integrally formed on opposing sides of the central panel. The body is manufactured from a pliable material that facilitates the movable connection between the central panel and the first side panel and second side panel. A cavity is formed to accommodate a human foot therein with the moving of the first side panel and the second side panel into their second positions. A retention mechanism is secured to the first side panel and is operable to releasably secure a portion of a sock. A pulling member is secure to the body providing a user interface to grasp the sock donning apparatus and utilize to apply a sock.

17 Claims, 3 Drawing Sheets

SOCK DONNING ASSISTANCE APPARATUS

PRIORITY UNDER 35 U.S.C SECTION 119(e) & 37 C.F.R. SECTION 1.78

This nonprovisional application claims priority based upon the following prior U.S. Provisional Patent Application entitled: Easy-On Sock and Stocking Pulller, Application No. 61/506,919 filed Jul. 12, 2011, in the name of Glenn Earl Higa, which is hereby incorporated by reference for all purposes.

FIELD OF THE INVENTION

The present invention relates to a sock donning assistance apparatus, more specifically but not by way of limitation, an apparatus operable to assist those with reduced mobility in the process of donning socks wherein the apparatus includes a plurality of integrally formed panels operable to receive an opening of a sock on one end while further providing a location to integrate a human foot with the apparatus so as to facilitate the donning of the sock.

BACKGROUND

Millions of individuals engage in the donning of socks as part of a daily dressing routine. Socks are routinely worn by individuals with a variety of shoes. In donning such articles of clothing, the individual must perform tasks such as but not limited to bending of the knee and flexing downward at the waist in order to don the socks. While this type of maneuver is not a challenge for a typical individual, those individuals with decreased mobility due to circumstances such as pregnancy, arthritis or obesity can be significantly challenged by such maneuvers.

For those who are either temporarily or permanently incapacitated, the maneuvers required to don socks can often require assistance from another individual. Many individuals however, do not have home healthcare assistance or live by themselves and assistance with such tasks is unavailable and the individual must perform the task of donning socks by themselves. While there is existing technology that provides assistance with the task of donning socks, current devices fail to provide good results in several areas.

One problem with existing technology is the stress placed on the opening of the sock. Devices often stretch the opening of the sock such that the elasticity of the sock is substantially diminished which results in disposal of the sock as the sock will not maintain its desired position on the calf of the user due to the lost elasticity. Another issue with current devices is that they are generally inflexible. The inflexibility of the devices often leads to discomfort to the user while trying to manipulate a rigid device around an approximately ninety degree turn of their heel. Additionally, current devices are not shaped appropriately so as to receive a foot and place the foot proximate the opening of the sock. Many existing devices are semicircular and do not accommodate feet of different widths and possess a shape that facilitates an easier transition of the foot into the sock opening.

Accordingly, there is a need for a sock donning apparatus that facilitates the application of a sock to an individual's foot wherein the individual suffers from reduced mobility that does not diminish the elasticity of the sock and further promotes an improved application process of the sock onto the foot.

SUMMARY OF THE INVENTION

It is the object of the present invention to provide a sock donning assistance apparatus that facilitates an improved application of a sock to a user's foot that suffers from reduced mobility.

Another object of the present invention is to provide a sock donning assistance apparatus that includes a plurality of integrally formed flexible panels.

Still another object of the present invention is to provide a sock donning assistance apparatus that is flexible so as to facilitate the application of a sock around the heel area of the foot.

Yet another object of the present invention is to provide a sock donning assistance apparatus that includes a grasping member that provides an interface for a user to grasp the apparatus during use.

A further object of the present invention is to provide a sock donning assistance apparatus that includes stabilization member so as to orient the apparatus in an accessible manner when the apparatus is superposed a floor.

An additional object of the present invention is to provide a sock donning apparatus that includes a sock retention mechanism to releasably secure the sock to the apparatus during the sock application process.

Still a further object of the present invention is to provide a sock donning apparatus that includes two opposing lateral panels that function to overlap during the sock application process.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 2:
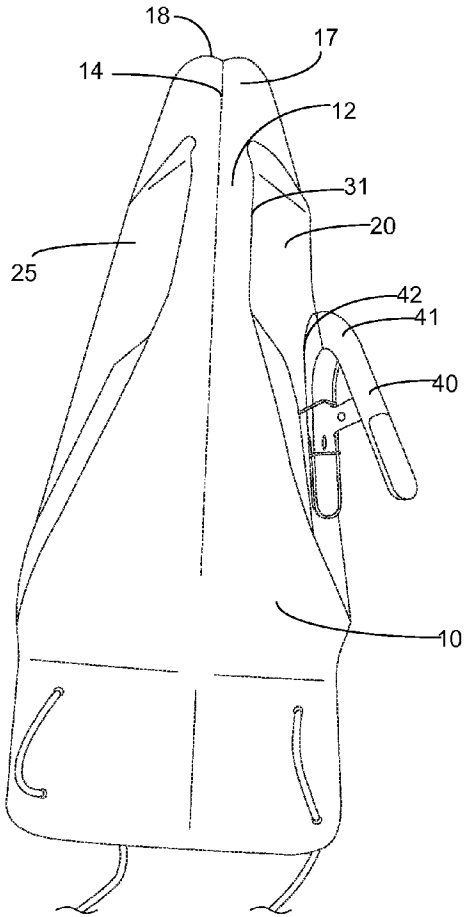
FIG. 2 is a top view of the present invention in its folded configuration.

Referring now to the drawings submitted herewith, wherein various elements depicted therein are not necessarily drawn to scale and wherein through the views and figures like elements are referenced with identical reference numerals, there is illustrated a sock donning apparatus 100 constructed according to the principles of the present invention.

Figure 3:
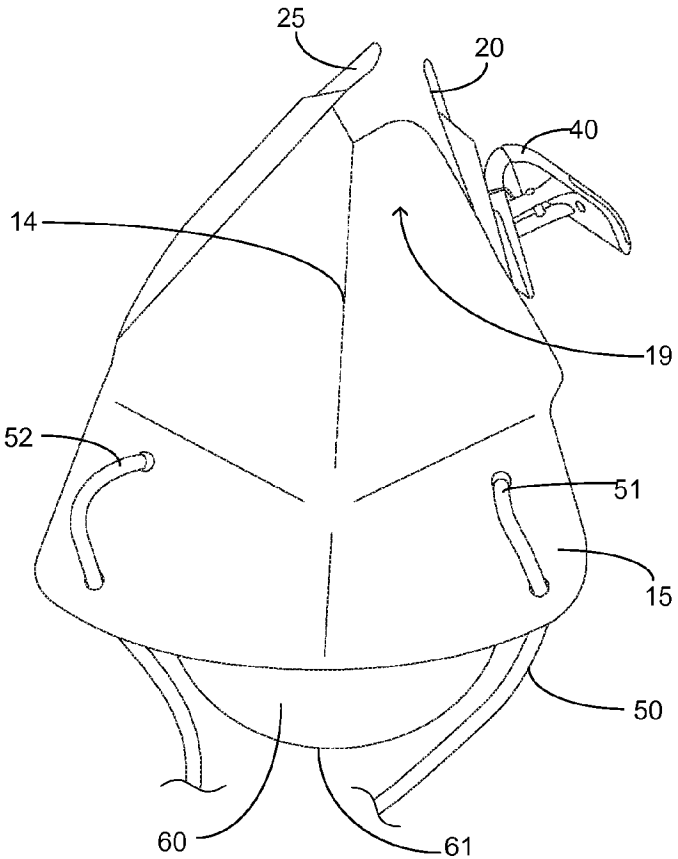
FIG. 3 is a rear end view of the present invention.

The sock donning apparatus 100 further includes a body 10 that is manufactured from a suitable durable pliable material such as but not limited to plastic. The body 10 further includes a central portion 12 having a longitudinal seam 14 located proximate the middle. The central portion 12 further includes a first end 15 and a second end 17 wherein the width of the central portion proximate the first end 15 is greater than the width of the central portion 12 proximate the second end 17. This difference in width creates a generally tapered shape that facilitate easier penetration of the first end 14 into an opening of a sock or stocking. The first end 15 is generally square in shape with the second end 17 being a modified-tapered shape having a rounded perimeter edge 18. The modified tapered shape of the second end 17 facilitates easier penetration of the opening of a conventional sock or stocking and further enhances the ability for the second end 17 to journal through the open passage of a convention sock or stocking while substantially reducing the risk of snagging the material resulting in damage thereto. The body 10 is folded in an angular manner along the longitudinal seam 14. The fold along the longitudinal seam 14 assists in forming the body into a shape that creates a cavity 19 operable to receive a human foot therein as shown in particular in FIG. 3. While the central portion 12 is illustrated herein as being generally tapered in shape, it is contemplated within the scope of the present invention that the central portion 12 could be formed in numerous different shapes and achieve the objectives as described herein.

Figure 1:
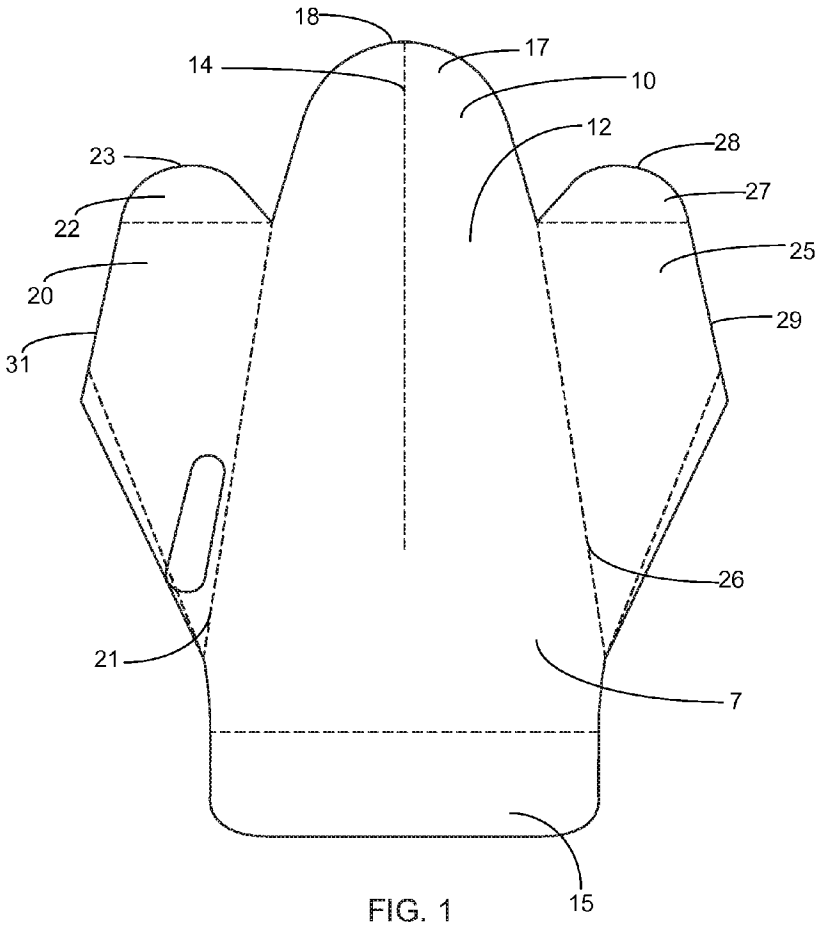
FIG. 1 is a bottom view of the present invention in a planar configuration.

The central portion 12 has integrally formed therewith a first side panel 20 and a second side panel 25. The first side panel 20 and second side panel 25 are on opposing sides of the central portion 12 and are operable to be angularly position with respect to the central portion 12. The first panel 20 is angularly positioned with respect to the central portion 12 along seam 21. The second panel 25 is angularly positioned with respect to the central portion along seam 26. As shown in FIG. 1, the first panel 20 and second panel 25 are placed in their first position wherein the first panel 20, second panel 25 and central portion 12 are generally in a planar configuration. In their second position, the first panel 20 and the second panel 25 are folded inwards toward the longitudinal seam 14 and are generally angularly oriented with the central portion 12 so as to create cavity 19. In their second position, the first panel 20 and second panel 25 are positioned such that the longitudinal edges 29, 31 are overlapping as shown in particular in FIG. 4. The overlapped position of the longitudinal edges 29, 31 are facilitated by the angular fold along the longitudinal seam 14 so as to accomplish the insertion of the body 10 into the opening of a sock or stocking and reduce any stretching thereof.

The first panel 20 further includes a first end 22 that is rounded in shape having a perimeter edge 23 that is generally arcuate in manner. The second panel 25 further includes a first end 27 that is rounded in shape also having a perimeter edge 28 that is arcuate. The arcuate shaped perimeter edges 23, 28 function to allow the sock donning apparatus 100 to penetrate into a sock or stocking while substantially reducing the probability of snagging the material so as to facilitate easier insertion of the body 10 into the sock or stocking. While the first panel 20 and second panel 25 are illustrated herein as having a rounded ends, it is contemplated within the scope of the present invention that the first panel 20 and second panel 25 could be formed in numerous different shapes in order to achieve the objectives as described herein.

A clip 40 is secured to the first panel 20 utilizing suitable durable techniques such as but not limited to mechanical fasteners or chemical adhesion. The clip 40 is a conventional spring clip having a first jaw 41 and a second jaw 42 biased together with spring or other similar device. The spring clip 40 has a first position and a second position. In the first position the spring clip 40 is positioned such that the first jaw 41 and second jaw 42 are moved away from each other so as to receive a portion of a conventional sock or stocking. In its second position the spring clip 40 is such that the first jaw 41 and second jaw 42 are biased against one another so as to releasably secure a portion of a conventional sock or stocking. The spring clip 40 functions to maintain the upper edge of the sock 2 in a fixed position relative to the body 10 during the process of donning the sock 2. As the donning process is near completion and the sock 2 has been successfully donned by the user, the spring clip 40 is designed to have a bias force that will allow the tension from the donning of the sock 2 release the portion of the sock 2 that is being secured by the spring clip 40. While a spring clip 40 has been illustrated and discussed herein functioning to assist in the positioning of the sock 2 relative to the body 10 during the sock donning process, it is further contemplated within the scope of the present invention that numerous suitable fasteners could be used in place of and/or in conjunction with the spring clip 40. Furthermore, while one spring clip 40 has been illustrated herein, it is additionally contemplated within the scope of the present invention that more than one spring clip 40 could be utilized.

A pulling member 50 is secured to the body 10 proximate the first end 15. The pulling member 50 is secured to the body 10 utilizing suitable durable techniques such as mechanical fasteners. The pulling member 50 functions to provide an interface for the user to grasp and transition the sock donning apparatus 100 from its first initial position to a final position wherein the sock donning apparatus 100 has facilitated the application of a sock to a user. The pulling member 50 includes a first end 51 and a second end 52 and is generally elongated so as to increase the ability for a user to grasp with minimal movement of their body. While numerous materials could be utilized to form the pulling member 50, good results have been achieved utilizing a string or cord.

Integrally formed with the bottom 9 of the body 10 intermediate the first end 51 and second end 52 of the pulling member 50 is the stabilization member 60. The stabilization member 60 is manufactured from a durable suitable material such as but not limited to plastic and is secured to the body 10 utilizing suitable durable techniques such as but not limited to chemical adhesion. The stabilization member 60 functions to position the body 10 in a generally lateral position when the body 10 is place on the floor and the body 10 has been placed in its second position wherein the central portion 12 is folded angularly along the longitudinal seam and the first panel 20 and second panel 25 have been angularly position. The stabilization member 60 positions the body 10 wherein the upper surface 7 is in a generally horizontal position so as to facilitate an increased ease of engaging the sock donning apparatus 100 with a foot. The stabilization member 60 is generally rounded in shape having an arcuate perimeter edge 61. While the stabilization member 60 is illustrated herein as being generally half-rounded in shape, it is contemplated within the scope of the present invention that the stabilization member 60 could be manufactured in numerous different shapes and accomplish the objectives as described herein.

Figure 4:
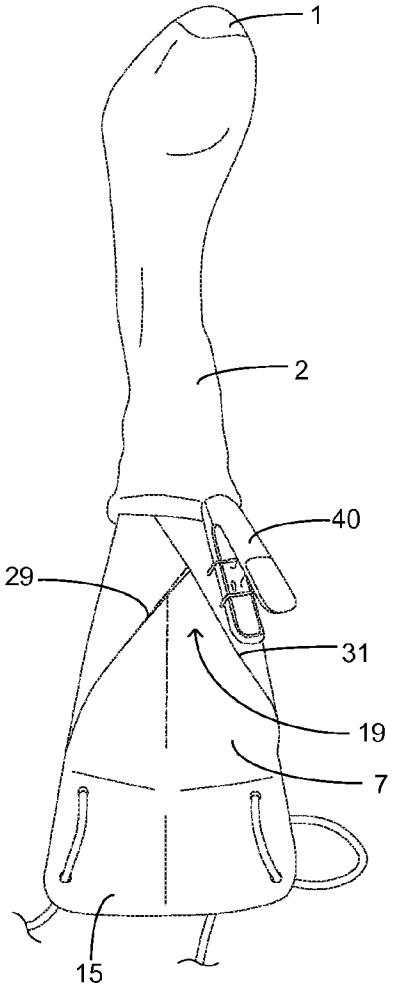
FIG. 4 is a top view of the present invention partially engaged with an exemplary sock.
Figure 5:
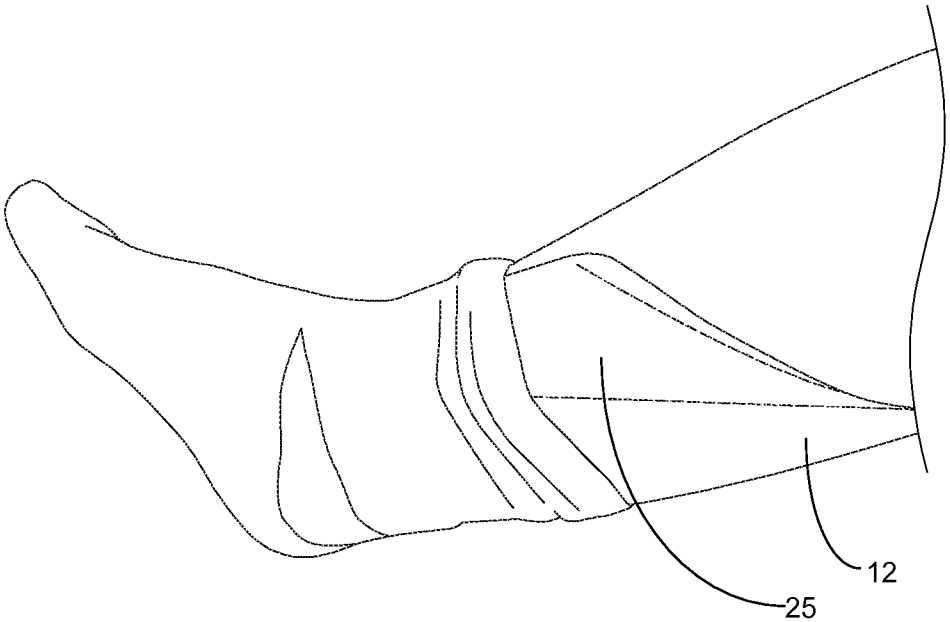
FIG. 5 is a side view of the present invention during the application process of a sock.

Referring to FIGS. 2, 4 and 5 a description of the operation is as follows. In use, the central portion 12 is generally angular in manner and the first side panel 20 and second side panel 25 are positioned such that the longitudinal edge 31 is overlapping longitudinal edge 29 so as to create the cavity 19. The cavity 19 is of suitable size to accommodate a human foot therein. The longitudinal edges 31, 29 are angular with respect to each other so as to facilitate the journaling of the user's foot substantially into the cavity 19 allowing the toes of the user's foot to be proximate the end 1 of the sock 2 when the sock 2 is placed in a bunched position such that the material of the sock 2 is gathered proximate the second end 17 of the body 10. The user engages the sock 2 with the body 10 and gathers the sock 2 such that it is substantially gathered proximate the second end 17. Ensuing the gathering of the sock 2, the user places a portion of the sock 2 into the spring clip 40 so as to releasably secure the sock 2 in position. Subsequent placing a portion of the sock into the spring clip 40 the user will grasp the pulling member 50 and begin pulling the sock donning apparatus 100 in a generally upwards direction towards the user's leg. As the sock donning apparatus 100 is moved from its initial position the first side panel 20 and second side panel 25 begin to unfold as shown in particular in FIG. 5. This unfolding of the first side panel 20 and second side panel 25 allows the foot of the user to substantially penetrate into the sock 2 so as to facilitate the traversing of the toes of the user such that they are proximate the end 1 of the sock 2. This unfolding action of the first side panel 20 and second side panel 25 further places a slight outward force on the sock 2 thereby substantially inhibiting the gathering or bunching up of the sock 2 during the donning process. As the sock donning apparatus 100 is transitioned from its first position, the pliable nature of the body 10 further enhances the proper application of the sock 2 as the sock donning apparatus 100 is transitioned around the heel of the foot of the user. This ensures an enhanced application of the sock while avoiding the stretching thereof. As the user continues to apply force to the pulling member 50 and the sock 2 is substantially applied to the foot, the spring clip 40 releases the portion of the sock 2 that was releasably secured therein once the force from the pulling of the sock 2 against the foot exceeds that of the bias force of the spring clip 40. At this point the sock 2 has been completely applied to the user's foot. The body 10 is manufactured of a pliable and resilient material such the central portion 12 will transition back to a folded configuration along longitudinal seam 14 and the first side panel 20 and second side panel 25 will remain in an angular manner with respect to the central portion 12.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A sock donning apparatus comprising:

a central portion, being generally planar in manner, said central portion being tapered in shape, said central portion having a first end and a second end, said central portion having longitudinal seam extending partially along a center region, said central portion being longitudinally foldable along said longitudinal seam so as to create a first portion and a second portion, wherein said first end of said central portion is generally arcuate in shape, said first end being of suitable size to be at least partially journaled into the opening of a sock;

a first side panel, said first side panel being integrally formed with said central portion, said first side panel being movable in relation to said central portion;

a second side panel, said second side panel being integrally formed with said central portion opposite said first side panel, said second side panel being movable in relation to said central portion;

at least one retention mechanism, said at least one retention mechanism being secured to said first side panel, said at least one retention mechanism operable to receive at least a portion of a sock and releasably secure the sock therein; and wherein said first side panel and said second side panel are movable so as to at least partially overlap to create a cavity of sufficient size to accommodate a human foot therein.

2. The sock donning apparatus as recited in claim 1, and further including a pulling member, said pulling member secured to said second end of said central portion, said pulling member operable to provide an interface for a user to engage the sock donning apparatus.

3. The sock donning apparatus as recited in claim 2, wherein said first side panel further includes a first end and a second end, said first end having a rounded perimeter edge.

4. The sock donning apparatus as recited in claim 3, wherein said second side panel further includes a first end and a second end, said first end having a rounded perimeter edge.

5. The sock donning apparatus as recited in claim 4, wherein the sock donning apparatus is manufactured from a pliable material.

6. An apparatus operable to assist an individual with reduced physical abilities to apply a sock to their foot comprising:

a body, said body further including a central panel, said central panel having a first end and a second end, said central panel having a width proximate said second end that is greater than that of the width proximate said first end, said central panel further including a longitudinal seam, said central panel being longitudinally foldable along said longitudinal seam into a first half and a second half, said first half and said second half being longitudinally angular with respect to each other;

a first side panel, said first side panel being integrally formed with said central panel, said first side panel being movable with respect to said central panel, said first side panel being positioned in a general angular manner with respect to said central panel;

a second side panel, said second side panel being integrally formed with said central panel opposing said first side panel, said second side panel being movable with respect to said central panel, said second side panel being positioned in a general angular manner with respect to said central panel; and a stabilization member, said stabilization member being secured to said body proximate said second end, said stabilization member being perpendicular to said body, said stabilization member operable to control the lateral stability of said body;

wherein said second side panel and said first side panel are movable such that at least a portion thereof overlaps to create a cavity, said cavity being of sufficient size to accommodate a human foot therein.

7. The apparatus as recited in claim 6, and further including a retention mechanism, said retention mechanism being secured to said second panel, said retention mechanism operable to receive a portion of a sock and releasably secure.

8. The sock donning apparatus as recited in claim 7, wherein said first side panel and said second side panel further include a first end and a second end, said first end of said first side panel and said second side panel being rounded in shape so as to facilitate penetration into a sock.

9. The sock donning apparatus as recited in claim 8, and further including a pulling member, said pulling member being generally elongated in shape, said pulling member being secured to said second end of said central panel, said pulling member providing an interface for a user to grasp the apparatus.

10. The sock donning apparatus as recited in claim 9, wherein said body is manufactured from a durable pliable material so as to facilitate the movement of said body around a foot of a user.

11. The sock donning apparatus as recited in claim 10, wherein said first panel and said second panel are operable to move away from said central panel during the application of a sock.

12. The sock donning apparatus as recited in claim 11, wherein said first side panel and said second side panel are operable to at least partially overlap so as to be positioned to be journaled in an opening of a sock and substantially reduce any stretching thereof.

13. A sock donning apparatus operable to assist an individual with reduced mobility in the application of a sock to their foot comprising:

a body, said body being manufactured from a pliable material, said body further including a central panel, said central panel having a longitudinal seam extending partially the length of said central panel wherein said longitudinal seam divides the central panel into a first half and a second half, said central being longitudinally foldable along said longitudinal seam, said body having an upper surface and a lower surface, said first half and said second half being approximately equal in sizes, said central panel configured such that said first half and said second half are angularly oriented with respect to each other along said longitudinal seam, said central panel further including a first end and a second end, said central panel being tapered in shape such that the width of said central panel proximate said first end is less than that of said second end, said first end further including an arcuate perimeter edge;

a first side panel, said first side panel being integrally formed with said first half of said central panel, said first side panel being movable in relation to said central panel, said first side panel having a first end and a second end, said first side panel having an outer surface and an inner surface, said first side panel further including an outer edge, said first side panel having a first position and a second position;

a second side panel, said second side panel being integrally formed with said second half of said central panel, said second side panel being movable in relation to said central panel, said second side panel having a outer surface and an inner surface, said second side panel having a first end and a second end, said second side panel further including an outer edge, said second side panel having a first position and a second position;

a stabilization member, said stabilization member being secured to said body proximate said second end, said stabilization member extending outward from said lower surface of said body and being perpendicular thereto, said stabilization member operable to control the lateral stability of said body upon the sock donning apparatus being placed on a horizontal support structure;

a cavity, said cavity being formed subsequent said first side panel and said second side panel being placed in said second position, said cavity being of sufficient size to accommodate a human foot.

14. The sock donning apparatus as recited in claim 13, and further including a clip, said clip being secured to said outer surface of said first side panel, said clip having a first jaw and a second jaw, said clip having a first position and a second position, said clip operable to receive therein a portion of a sock subsequent the sock donning apparatus being journaled into an opening of a sock.

15. The sock donning apparatus as recited in claim 14, and further including a pulling member, said pulling member being generally elongated in shape, said pulling member having a first end and a second end, said pulling member being secured to said second end of said central panel, said pulling member providing an interface for a user to grasp the apparatus.

16. The sock donning apparatus as recited in claim 15, wherein said first end of said first side panel further includes an arcuate shaped perimeter edge.

17. The sock donning apparatus as recited in claim 16, wherein said first end of said second side panel further includes an arcuate shaped perimeter edge.

* * * * *